US009210767B2

(12) United States Patent
Chang et al.

(10) Patent No.: US 9,210,767 B2
(45) Date of Patent: Dec. 8, 2015

(54) LIGHTING APPARATUS AND LIGHT EMITTING DIODE DEVICE THEREOF

(71) Applicant: Everlight Electronics Co., Ltd., New Taipei (TW)

(72) Inventors: Chung-kai Chang, New Taipei (TW); Shun-Chang Li, New Taipei (TW); Cheng Hsi Hung, New Taipei (TW)

(73) Assignee: Everlight Electronics Co., Ltd. (TW)

( * ) Notice: Subject to any disclaimer, the term of this patent is extended or adjusted under 35 U.S.C. 154(b) by 449 days.

(21) Appl. No.: 13/720,821

(22) Filed: Dec. 19, 2012

(65) Prior Publication Data

US 2013/0154489 A1 Jun. 20, 2013

Related U.S. Application Data

(63) Continuation-in-part of application No. 13/347,630, filed on Jan. 10, 2012, now abandoned.

(30) Foreign Application Priority Data

Dec. 20, 2011 (TW) ..... 100147471 A

(51) Int. Cl.
*H05B 37/00* (2006.01)
*H05B 37/02* (2006.01)
*H05B 33/08* (2006.01)

(52) U.S. Cl.
CPC ..... *H05B 37/02* (2013.01); *H05B 33/083* (2013.01); *H05B 33/0872* (2013.01)

(58) Field of Classification Search
CPC ..... H05B 37/036; H05B 33/083
USPC ..... 315/185 R, 192, 291, 294, 297, 307; 345/82–84
See application file for complete search history.

(56) References Cited

U.S. PATENT DOCUMENTS

| | | | |
|---|---|---|---|
| 5,493,101 | A | 2/1996 | Innes |
| 6,040,663 | A | 3/2000 | Bucks et al. |
| 7,206,015 | B2 | 4/2007 | Tang et al. |
| 7,213,940 | B1 | 5/2007 | Van De Ven et al. |
| 7,626,346 | B2 | 12/2009 | Scilla |
| 7,633,037 | B2 | 12/2009 | Hoffman |

(Continued)

FOREIGN PATENT DOCUMENTS

| | | |
|---|---|---|
| CN | 1830096 | 9/2006 |
| CN | 101674693 | 3/2010 |

(Continued)

*Primary Examiner* — Jason M Crawford
(74) *Attorney, Agent, or Firm* — Han IP Corporation

(57) ABSTRACT

A lighting emitting diode (LED) device includes a first adjust module and a second adjust module. The first adjust module includes at least one first LED and has a first internal impedance having a first characteristic curve. A range covered by the first characteristic curve includes a first incomplete conduction region and a first conduction region. As the current increases from zero value and up, the first internal impedance decreases exponentially in the first incomplete conduction region, is approximately linear in the first conduction region. The second adjust module includes an impedance-providing component and an electronic component coupled in series. The second adjust module is coupled in parallel with the first adjust module. The second adjust module has a second internal impedance having a second characteristic curve. The first characteristic curve and the second characteristic curve match one another.

6 Claims, 15 Drawing Sheets

(56) References Cited

U.S. PATENT DOCUMENTS

| | | | | |
|---|---|---|---|---|
| 2007/0139928 | A1 | 6/2007 | Wang et al. | |
| 2007/0171159 | A1* | 7/2007 | Lee | 345/83 |
| 2008/0224025 | A1 | 9/2008 | Lyons et al. | |
| 2009/0206758 | A1 | 8/2009 | Kobilke | |
| 2011/0068701 | A1* | 3/2011 | van de Ven et al. | 315/185 R |
| 2011/0221037 | A1 | 9/2011 | Engel et al. | |
| 2012/0025228 | A1* | 2/2012 | Hsieh et al. | 257/89 |
| 2012/0176047 | A1* | 7/2012 | Li et al. | 315/185 R |
| 2014/0239321 | A1 | 8/2014 | Lu et al. | |

FOREIGN PATENT DOCUMENTS

| | | | |
|---|---|---|---|
| CN | 102217416 | | 10/2011 |
| CN | 102595675 | | 7/2012 |
| CN | 104009143 | | 8/2014 |
| DE | 102008057347 | | 5/2010 |
| DE | 102009022070 | | 11/2010 |
| EP | 1662583 | A1 | 5/2006 |
| EP | 2477458 | | 7/2012 |
| JP | 06-151958 | | 5/1994 |
| JP | 2004-253804 | | 9/2004 |
| JP | 2007-110075 | | 4/2007 |
| JP | 2007-201473 | | 8/2007 |
| JP | 2008-091436 | | 4/2008 |
| JP | 2012-146985 | | 8/2012 |
| TW | 200729534 | | 8/2007 |
| TW | 200734997 | | 9/2007 |
| TW | 200822802 | | 5/2008 |
| TW | 200826320 | | 6/2008 |
| TW | 200908030 | | 2/2009 |
| TW | 201126778 | | 8/2011 |
| TW | 201206238 | | 2/2012 |
| TW | 201230867 | | 7/2012 |

* cited by examiner

LIGHTING APPARATUS AND LIGHT EMITTING DIODE DEVICE THEREOF

CROSS-REFERENCE TO RELATED APPLICATION

This application is a continuation-in-part of U.S. patent application Ser. No. 13/347,630, filed on Jan. 10, 2012, which claims the priority benefit of Taiwan Patent Application No. 100101135, filed on Jan. 12, 2011. This application claims the priority benefit of Taiwan Patent Application No. 100147471, filed on Dec. 20, 2011. The entirety of the above-mentioned patent applications are hereby incorporated by reference and made a part of this specification.

BACKGROUND

1. Technical Field

The present invention relates to a lighting apparatus and the structure of a light emitting diode (LED) device thereof and, more particularly, to an LED device with reduced attenuation in brightness (luminous decay, light decay, light attenuation, light decline or light degradation) and a technique that reduces attenuation in brightness in red LED caused by an increase in temperature.

2. Description of Related Art

With demand for environmental protection on the rise, the utilization of LEDs for illumination in people's daily life has become an inevitable trend. According to conventional technologies, blue and red LED chips are often used in lighting apparatuses that provide warm lighting and for which yellow and red phosphors are used during the manufacturing thereof. As the time in operation of this type of lighting apparatuses increases, the ambient temperature surrounding the lighting apparatus typically rises accordingly. In particular, as red LEDs typically have more pronounced attenuation in brightness compared to blue LEDs, the attenuation in brightness (luminous decay, light decay, light attenuation, light decline or light degradation) is generally more severe in red LEDs than in blue LEDs. As such, the lighting provided by conventional lighting apparatuses tends to change drastically over time and the lighting performance of such lighting apparatuses is severely impaired.

Therefore, it is important for designers in this field to provide lighting apparatuses that are capable of long and stable operation with high efficiency in lighting.

SUMMARY

The present invention provides an LED device that is capable of effectively reducing the attenuation in brightness in a string of red LEDs thereof caused by an increase in temperature.

The present invention further provides a lighting apparatus that is capable of effectively reducing the attenuation in brightness in a string of red LEDs thereof caused by an increase in temperature. Advantageously, the lighting apparatus can emit light under high ambient temperature such that the emitted light still satisfies the requirement of the 7-step macadam and, optimally, the requirement of the 4-step macadam. In one aspect, an LED device may comprise a first LED, at least one impedance-providing component, and a driver. The first LED may have an internal impedance and may be configured to emit light of a first wavelength. The at least one impedance-providing component may be coupled in parallel with the first LED, and may provide an internal impedance having a value that varies in positive proportion with a variation in an ambient temperature. The driver may be respectively coupled in series with the first LED and the at least one impedance-providing component. The driver may provide a drive current divided to flow through the first LED and the at least one impedance-providing component according to the internal impedance and the internal impedance.

In one embodiment, the drive current is divided into a first partial drive current that flows through the first LED and a second partial drive current that flows through the at least one impedance-providing component. A ratio between a value of the first partial drive current and a value of the second partial drive current may be proportional to a ratio between a value of the internal impedance provided by the at least one impedance-providing component and a value of the internal impedance of the first LED.

In one embodiment, the at least one impedance-providing component may comprise a plurality of impedance-providing components each of which providing a respective shunt impedance having a respective value that varies in positive proportion with the variation in the ambient temperature.

In one embodiment, the at least one impedance-providing component may comprise a semiconductor component, a thermistor, a transistor, or a diode having a positive temperature coefficient.

In one embodiment, the LED device may further comprise a second LED that is respectively coupled in series with the driver, the first LED, and the at least one impedance-providing component. The second LED may be configured to emit light of a second wavelength.

In one embodiment, the second LED, the first LED, and the driver may be coupled in series such that the second LED is coupled between the driver and the first LED or the first LED is coupled between the driver and the second LED.

In one embodiment, the second LED may comprise a blue LED, a green LED, a yellow LED, an orange LED, an ultraviolet LED, a near blue LED, a white LED, or a combination thereof.

In another aspect, an LED device may comprise a first LED, at least one impedance-providing component, a string of one or more second LEDs, and a driver. The first LED may have an internal impedance and may be configured to emit light of a first wavelength. The at least one impedance-providing component may be coupled in parallel with the first LED and provide an internal impedance having a value that varies in positive proportion with a variation in an ambient temperature. The string of one or more second LEDs may be respectively coupled in series with the first LED and the at least one impedance-providing component. Each of the one or more second LEDs may be configured to emit light of a respective wavelength that is less than the first wavelength. The driver may be respectively coupled in series with the first LED, the string of one or more second LEDs, and the at least one impedance-providing component. The driver may provide a drive current to the string of one or more second LEDs. The drive current is divided to flow through the first LED and the at least one impedance-providing component according to the internal impedance and the internal impedance.

In one embodiment, the drive current is divided into a first partial drive current that flows through the first LED and a second partial drive current that flows through the at least one impedance-providing component. A ratio between a value of the first partial drive current and a value of the second partial drive current may be proportional to a ratio between a value of the internal impedance provided by the at least one impedance-providing component and a value of the internal impedance of the first LED.

In one embodiment, the at least one impedance-providing component may comprise a plurality of impedance-providing components each providing a respective shunt impedance having a respective value that varies in positive proportion with the variation in the ambient temperature.

In one embodiment, the at least one impedance-providing component may comprise a semiconductor component, a thermistor, a transistor, or a diode having a positive temperature coefficient.

In one embodiment, the first LED may comprise a red LED, and the string of one or more second LEDs may comprise a blue LED, a green LED, a yellow LED, an orange LED, an ultraviolet LED, a near blue LED, a white LED, or a combination thereof.

In one embodiment, the LED device may further comprise a string of one or more third LEDs that is respectively coupled in series with the driver, the first LED, the string of one or more second LEDs, and the at least one impedance-providing component. Each of the one or more third LEDs may be configured to emit light of a respective wavelength that is less than the first wavelength.

In one embodiment, the string of one or more third LEDs may be coupled in series and between the driver and the first LED.

In one embodiment, the first LED may comprise a red LED, and the string of one or more third LEDs may comprise a blue LED, a green LED, a yellow LED, an orange LED, an ultraviolet LED, a near blue LED, a white LED, or a combination thereof.

In one aspect, a lighting apparatus comprising a first LED, at least one impedance-providing component, a second LED and a driver is provided. The first LED has an internal impedance and a first light decay. The at least one impedance-providing component is coupled in parallel with the first LED. The at least one impedance-providing component provides an internal impedance having a value that varies in positive proportion with a variation in an ambient temperature. The second LED is respectively coupled in series with the first LED and the at least one impedance-providing component. The second LED has a second decay. The first light decay is more severe than the second light decay. The driver is respectively coupled in series with the first LED, the second LED and the at least one impedance-providing component. The driver provides a drive current to the second LED. The drive current is divided to flow through the first LED and the at least one impedance-providing component according to the internal impedance and the internal impedance.

In one embodiment, the at least one impedance-providing component comprises a semiconductor component, a thermistor, a transistor, or a diode having a positive temperature coefficient.

In one embodiment, a third LED is respectively coupled in series with the first LED, the second LED, the at least one impedance-providing component and the driver. The third LED has a third light decay.

In one embodiment, the first light decay is more severe than the third light decay.

In one embodiment, the third LED is coupled in series and between the driver and the first LED.

In one embodiment, the first LED comprises a red LED. The second LED comprises a blue LED, a green LED, a yellow LED, an orange LED, an ultraviolet LED, a near blue LED, a white LED, or a combination thereof. The third LED comprises a blue LED, a green LED, a yellow LED, an orange LED, an ultraviolet LED, a near blue LED, a white LED, or a combination thereof.

In one embodiment, the drive current is divided into a first partial drive current that flows through the first LED and a second partial drive current that flows through the at least one impedance-providing component. A ratio between a value of the first partial drive current and a value of the second partial drive current is proportional to a ratio between a value of the internal impedance provided by the at least one impedance-providing component and a value of the internal impedance of the first LED.

In one aspect, a lighting apparatus may comprise an LED device. The LED device may include a first LED, at least one impedance-providing component, and a driver. The first LED may have an internal impedance and may be configured to emit light of a first wavelength. The at least one impedance-providing component may be coupled in parallel with the first LED and may provide an internal impedance having a value that varies in positive proportion with a variation in an ambient temperature. The driver may be respectively coupled in series with the first LED, and the at least one impedance-providing component. The driver may provide a drive current that is divided into a first partial drive current that flows through the first LED and a second partial drive current that flows through the at least one impedance-providing component. A ratio between a value of the first partial drive current and a value of the second partial drive current may be proportional to a ratio between a value of the internal impedance provided by the at least one impedance-providing component and a value of the internal impedance of the first LED.

In one embodiment, the at least one impedance-providing component may comprise a semiconductor component, a thermistor, a transistor, or a diode having a positive temperature coefficient.

In one embodiment, the lighting apparatus may further comprise a string of one or more second LEDs that is respectively coupled in series with the first LED and the driver. Each of the one or more second LEDs may be configured to emit light of a respective wavelength that is less than the first wavelength. In another embodiment, the lighting apparatus may additionally comprise a string of one or more third LEDs that is respectively coupled in series with the driver, the first LED, and the string of one or more second LEDs. Each of the one or more third LEDs may be configured to emit light of a respective wavelength that is less than the first wavelength.

In one embodiment, the string of one or more third LEDs may be coupled in series and between the driver and the first LED.

In one embodiment, the first LED may comprise a red LED. The string of one or more second LEDs may comprise a blue LED, a green LED, a yellow LED, an orange LED, an ultraviolet LED, a near blue LED, a white LED, or a combination thereof. The string of one or more third LEDs may comprise a blue LED, a green LED, a yellow LED, an orange LED, an ultraviolet LED, a near blue LED, a white LED, or a combination thereof.

In one embodiment, each of the at least one first LED may be coupled in parallel with a respective one of the at least one impedance-providing component. The lighting apparatus may further comprise a plurality of strings of one or more second LEDs. Each string of one or more second LEDs may be respectively coupled in series with a respective one of the at least one first LED and the driver. Each LED of each string of one or more second LEDs may be configured to emit light of a respective wavelength that is less than the first wavelength.

In one aspect, an LED device may comprise a first adjustment module and a second adjustment module. The first adjustment module may comprise at least one first LED and may have a first internal impedance, and may be coupled to receive a first current. A first characteristic curve may represent a relationship between the first internal impedance and the first current with a range of the first characteristic curve including a first incomplete conduction region and a first conduction region. In the first incomplete conduction region the first internal impedance may decrease exponentially as the first current increases. The first internal impedance may be approximately linear in the first conduction region. The second adjustment module may comprise an impedance-providing component and an electronic component coupled in series, and may be coupled to receive a second current. The second adjustment module and the first adjustment module may be coupled in parallel. The second adjustment module may have a second internal impedance. A second characteristic curve may represent a relationship between the second internal impedance and the second current with a range of the second characteristic curve including a second incomplete conduction region and a second conduction region. In the second incomplete conduction region the second internal impedance may decrease exponentially as the second current increases. The second internal impedance may be approximately linear in the second conduction region. The first characteristic curve and the second characteristic curve may match one another.

In one embodiment, the impedance-providing component may comprise a semiconductor component or a thermistor having a positive temperature coefficient.

In one embodiment, the electronic component may comprise a diode, a Zener diode, an LED, a diode array, a Zener diode array, or an LED array.

In one embodiment, the LED device may further comprise a third adjustment module that comprises at least one second LED. The third adjustment module may be coupled in series with the first adjustment module and with the second adjustment module, respectively.

In one embodiment, the at least one first LED may emit light of a first wavelength, and the at least one second LED may emit light of a second wavelength that is different from the first wavelength.

In one embodiment, the at least one first LED and the at least one second LED may comprise a red LED and a blue LED, respectively.

In one aspect, an LED device may comprise a first LED array and a second LED array coupled in series with an impedance-providing component. The first LED array may have a first internal impedance, and may be coupled to receive a first current. A first characteristic curve may represent a relationship between the first internal impedance and the first current. The serially-coupled second LED array and the impedance-providing component may be coupled in parallel with the first LED array and receiving a second current. The serially-coupled second LED array and the impedance-providing component may have a second internal impedance. A second characteristic curve may represent a relationship between the second internal impedance and the second current. The first characteristic curve and the second characteristic curve may match one another.

In one embodiment, a range of the first characteristic curve may include a first incomplete conduction region and a first conduction region; in the first incomplete conduction region the first internal impedance may decrease exponentially as the first current increases; the first internal impedance may be approximately linear in the first conduction region; a range of the second characteristic curve may include a second incomplete conduction region and a second conduction region; in the second incomplete conduction region the second internal impedance may decrease exponentially as the second current increases; and the second internal impedance may be approximately linear in the second conduction region.

In one embodiment, each of the first LED array and the second LED array may respectively comprise an array of a plurality of red LEDs.

In one embodiment, the first internal impedance may be approximately equal to an internal impedance of the second LED array.

In one embodiment, the impedance-providing component may comprise a semiconductor component or a thermistor having a positive temperature coefficient.

In one aspect, an LED device may comprise a first LED array and a second adjustment module. The first LED array may have a first internal impedance and may be coupled to receive a first current. A first characteristic curve may represent a relationship between the first internal impedance and the first current with a range of the first characteristic curve including a first incomplete conduction region and a first conduction region. In the first incomplete conduction region the first internal impedance may decrease exponentially as the first current increases. The first internal impedance may be approximately linear in the first conduction region. The second adjustment module may be coupled to receive a second current. The second adjustment module and the first adjustment module may be coupled in parallel. The second adjustment module may have a second internal impedance. A second characteristic curve may represent a relationship between the second internal impedance and the second current with a range of the second characteristic curve including a second incomplete conduction region and a second conduction region. In the second incomplete conduction region the second internal impedance may decrease exponentially as the second current increases. The second internal impedance may be approximately linear in the second conduction region. The first characteristic curve and the second characteristic curve may match one another.

In one embodiment, the second adjustment module may comprise an impedance-providing component and an electronic component coupled in series.

In one embodiment, the impedance-providing component may comprise a semiconductor component or a thermistor having a positive temperature coefficient.

In one embodiment, the electronic component may comprise a diode, a Zener diode, an LED, a diode array, a Zener diode array, or an LED array.

In one embodiment, the second adjustment module may comprise a second LED array, and each of the first LED array and the second LED array may respectively comprise an array of a plurality of red LEDs.

In one embodiment, the first internal impedance may be approximately equal to an internal impedance of the second LED array.

In one embodiment, the LED device may further comprise a third adjustment module coupled in series with the first LED array and with the second adjustment module, respectively.

In one embodiment, the first LED array may comprise at least one first LED. The third adjustment module may comprise at least one second LED. The at least one first LED may emit light of a first wavelength, and the at least one second LED may emit light of a second wavelength that is different from the first wavelength.

In one embodiment, the at least one first LED and the at least one second LED may comprise a red LED and a blue LED, respectively.

To facilitate better understanding of the features of and benefits provided by the present invention, implementation examples are provided in the Detailed Description section below with reference made to the accompanying drawings.

DETAILED DESCRIPTION OF PREFERRED EMBODIMENTS

Figure 1:
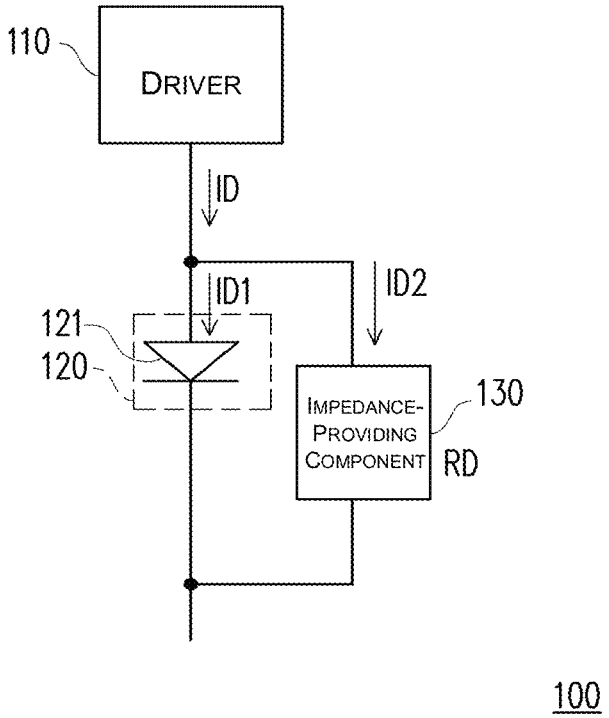
FIG. 1 is a block diagram of an LED device in accordance with an embodiment of the present invention.

FIG. 1 illustrates an LED device 100 in accordance with an embodiment of the present invention. The LED device 100 includes a driver 110, a string of one or more red LEDs 120, and an impedance-providing component 130. The driver 110 provides a drive current ID. The driver 110 may include a current generator that utilizes a voltage-controlled current source or an independent current source to provide the drive current ID, which is stable. As current generating devices capable of providing a stable drive current are well known in the art, in the interest of brevity detailed description of the driver 110 will not be provided.

The string of one or more red LEDs 120 includes a quantity of N of LEDs 121 coupled in series, where N is a positive integer. FIG. 1 illustrates one exemplary implementation, and N is equal to 1 in FIG. 1. When the quantity of LEDs in the string of one or more red LEDs 120 is greater than 1, the N LEDs are coupled in the same direction (e.g., positively biased with respect to the driver 110) and in series.

The impedance-providing component 130 is coupled in parallel with the string of one or more red LEDs 120. The impedance-providing component 130 provides an internal impedance RD the value of which depends on the ambient temperature surrounding the impedance-providing component 130. That is, according to Kirchhoff's current laws, the drive current ID provided by the driver 110 is divided into a first partial drive current ID1 and a second partial drive current ID2. The first partial drive current ID1 and the second partial drive current ID2 flow through the string of one or more red LEDs 120 and the impedance-providing component 130, respectively. The value of the drive current ID is equal to the sum of the value of the first partial drive current ID1 and the value of the second partial drive current ID2. More specifically, a voltage drop across the string of one or more red LEDs 120 is the same as a voltage drop across the impedance-providing component 130. Moreover, a ratio between the value of the first partial drive current ID1 and the value of the second partial drive current ID2 is proportional to a ratio between a value of the internal impedance RD provided by the impedance-providing component 130 and a value of an internal impedance of the string of one or more red LEDs 120. Notably, in at least one embodiment, the value of the internal impedance RD provided by the impedance-providing component 130 varies in positive proportion with a variation in the ambient temperature. For example, when the ambient temperature increases, the internal impedance RD increases proportionally.

In short, when the value of the internal impedance RD provided by the impedance-providing component 130 is greater than the value of the internal impedance of the string of one or more red LEDs 120, the value of the first partial drive current ID1 is greater than the value of the second partial drive current ID2. Conversely, when the value of the internal impedance RD provided by the impedance-providing component 130 is less than the value of the internal impedance of the string of one or more red LEDs 120, the value of the first partial drive current ID1 is less than the value of the second partial drive current ID2. When the value of the internal impedance RD provided by the impedance-providing component 130 is equal to the value of the internal impedance of the string of one or more red LEDs 120, the drive current ID is equally divided between the first partial drive current ID1 and the second partial drive current ID2.

Based on the description above, it is clear that, when the LED device 100 is in operation for a long period of time, the value of the internal impedance RD provided by the impedance-providing component 130 increases corresponding to an increase in the ambient temperature over time. As the value of the internal impedance RD increases, the value of the first partial drive current ID1 that flows through the string of one or more red LEDs 120 also increases. The increase in the first partial drive current ID1 due to an increase in the ambient temperature effectively compensates for a decrease, or attenuation, in the brightness of the string of one or more red LEDs 120 that would result due to an increase in the ambient temperature had there been no such compensation.

Additionally, the value of the internal impedance RD provided by the impedance-providing component 130 is selected based on the temperature-dependent attenuation in brightness of the string of one or more red LEDs 120 and a relationship between the brightness of the string of one or more red LEDs 120 and the drive current ID.

In at least one embodiment, the impedance-providing component 130 may comprise a thermistor with a positive temperature coefficient. When the LEDs 121 of the string of one or more red LEDs 120 comprise red LED chips, the impedance-providing component 130 may be a semiconductor component having a positive temperature coefficient, e.g., a transistor or a diode with a positive temperature coefficient, fabricated during the chip fabrication process.

Figure 2A:
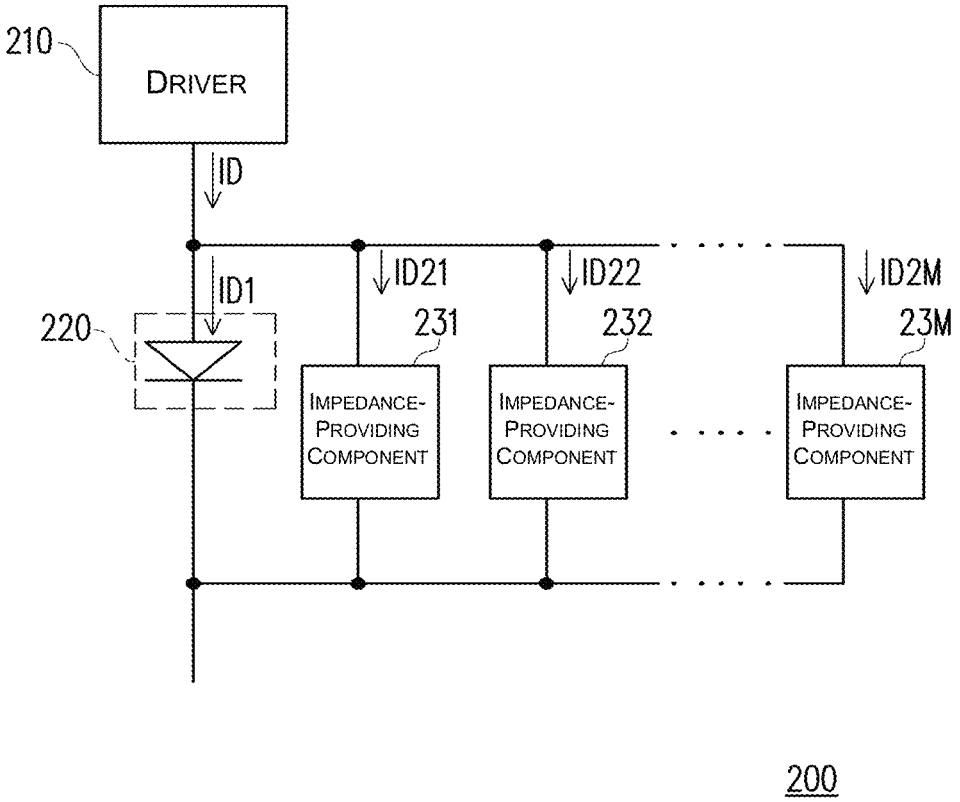
FIG. 2A is a block diagram of an LED device in accordance with another embodiment of the present invention.

FIG. 2A illustrates an LED device 200 in accordance with another embodiment of the present invention. The LED device 200 includes a driver 210, a string of one or more red LEDs 220, and a plurality of impedance-providing components 231-23M. Compared with the previous example, the LED device 200 includes a quantity of M of impedance-providing components 231-23M, where M is a positive integer. Each of the impedance-providing components 231-23M is coupled in parallel with the string of one or more red LEDs 220. Moreover, the plurality of impedance-providing components 231-23M provide a plurality of shunt impedance each having a respective value that varies in positive proportion with a variation in the ambient temperature. In the illustrated example, the string of one or more red LEDs 220 includes three LEDs coupled in series. The driver 210 provides a drive current ID that is divided into a plurality of partial drive currents ID1, ID21-ID2M. The values of the partial drive currents ID1, ID21-ID2M depend on the values of the internal impedance of the plurality of impedance-providing components 231-23M and a value of the internal impedance of the string of one or more red LEDs 220. More specifically, the partial drive current ID1 flows through the string of one or more red LEDs 220 to cause the string of one or more red LEDs 220 to emit light. Additionally, a voltage drop across the string of one or more red LEDs 220 is the same as a respective voltage drop across each of the plurality of the impedance-providing components 231-23M.

Figure 2B:
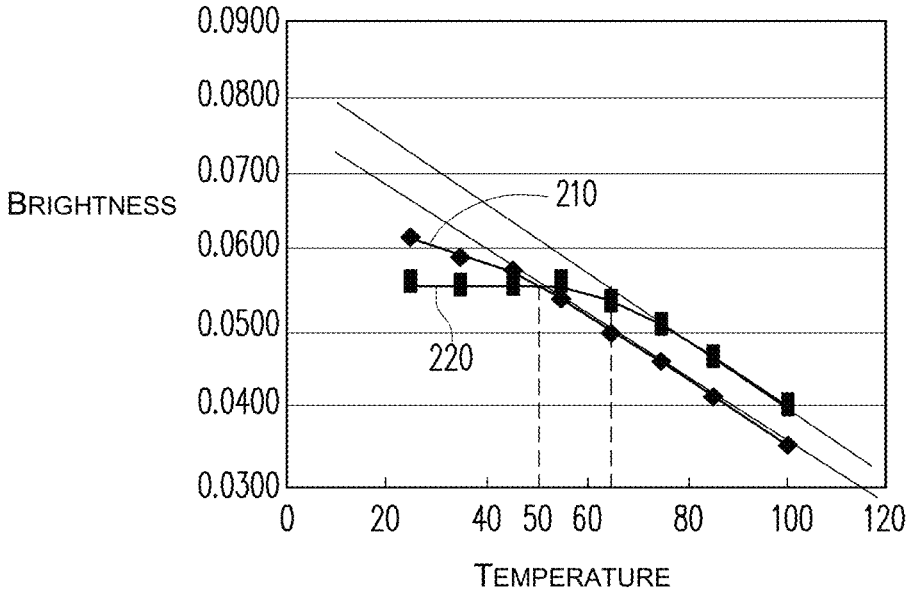
FIGS. 2B and 2C are diagrams showing a relationship between the lighting efficiency and relative brightness of an LED device and the ambient temperature.
Figure 2C:
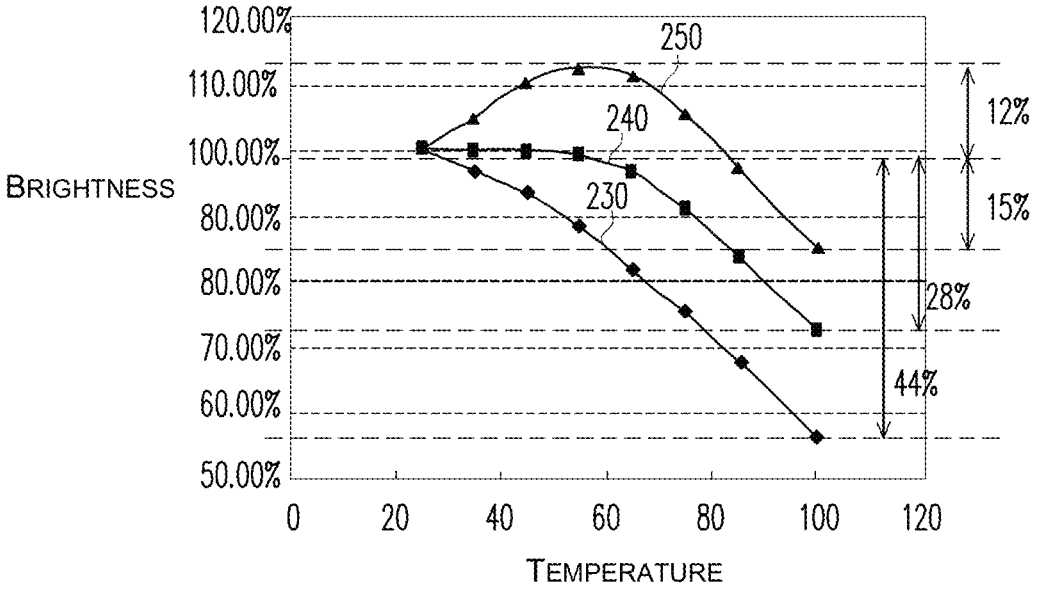

FIGS. 2B and 2C illustrate a relationship between the lighting efficiency and relative brightness of an LED device and the ambient temperature, respectively. As shown in FIG. 2B, a curve 210 shows a relationship between the lighting efficiency of a conventional LED device and the ambient temperature, where the conventional LED device includes a string of one or more red LEDs having two LEDs coupled in series without any impedance-providing component. A curve 220 shows a relationship between the lighting efficiency of a proposed LED device and the ambient temperature, where the proposed LED device includes a string of one or more red LEDs having two LEDs coupled in series and one or more impedance-providing components coupled in parallel with the string of one or more red LEDs. More specifically, the string of one or more red LEDs of the conventional LED device indicated by the curve 210 suffers a large attenuation in brightness when the ambient temperature is greater than 50° C. In contrast, the string of one or more red LEDs of the proposed LED device indicated by the curve 220 does not suffer a noticeable attenuation in brightness until the ambient temperature is greater than 60° C.

As shown in FIG. 2C, a curve 230 shows a relationship between the relative brightness of lighting of a conventional LED device and the ambient temperature, where the conventional LED device includes a string of one or more red LEDs having two LEDs coupled in series without any impedance-providing component. A curve 240 shows a relationship between the relative brightness of lighting of a proposed LED device and the ambient temperature, where the proposed LED device includes a string of two red LEDs coupled in series and two impedance-providing components that are coupled in parallel with each other and in parallel with the string of two red LEDs. A curve 250 shows a relationship between the relative brightness of lighting of another proposed LED device and the ambient temperature, where the proposed LED device includes a string of three red LEDs coupled in series and three impedance-providing components that are coupled in parallel with each other and in parallel with the string of three red LEDs. More specifically, when the ambient temperature is 100° C., the attenuation in brightness in the string of one or more red LEDs indicated by the curve 230 is 44%, the attenuation in brightness in the string of two red LEDs indicated by the curve 240 is 28%, and the attenuation in brightness in the string of three red LEDs indicated by the curve 250 is merely 15%.

Figure 3A:
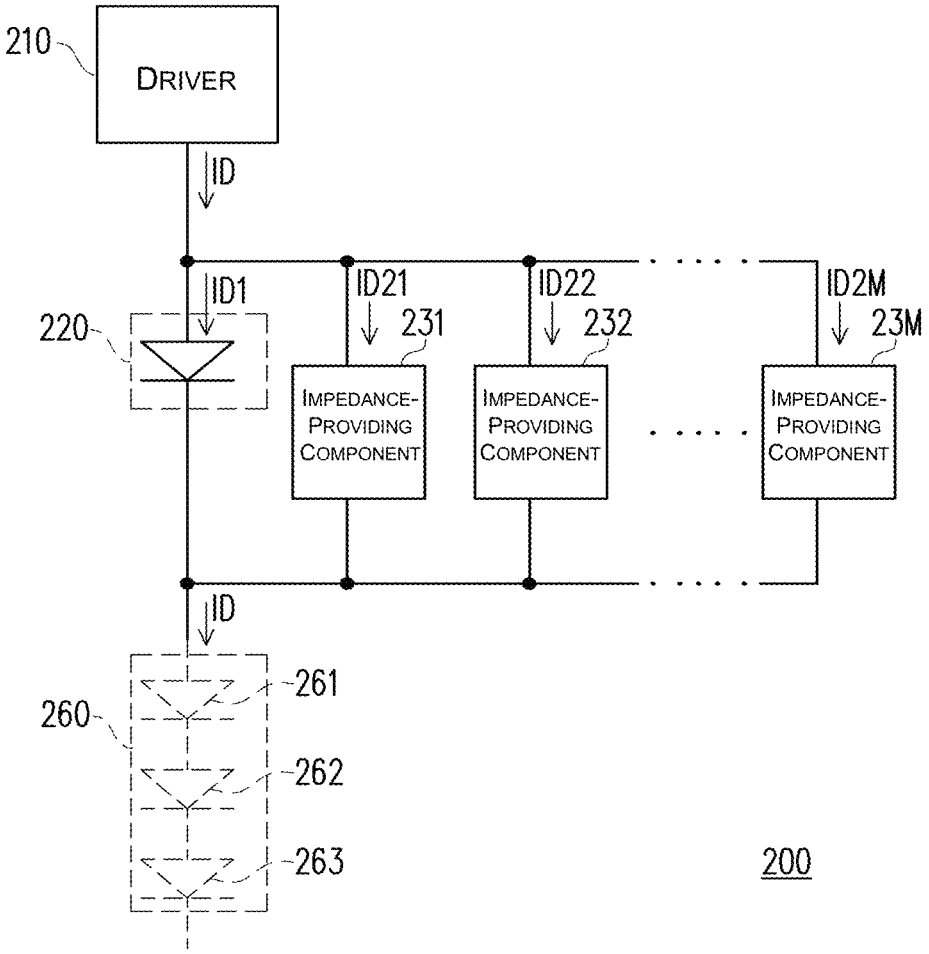
FIG. 3A is a block diagram of an LED device in accordance with yet another embodiment of the present invention.

FIG. 3A illustrates an LED device 200 in accordance with yet another embodiment of the present invention. Compared with the example shown in FIG. 2A, the LED device 200 in FIG. 3A further includes an LED string 260. The LED string 260 and the string of one or more red LEDs 220 are coupled in series with the driver 210, and receive the drive current ID to emit light. The LED string 260 includes one or more non-red LEDs. In the example shown, the LED string 260 includes a plurality of non-red LEDs 261-263 that are coupled in series. A current input terminal of the LED 261 is coupled to a current output terminal of the string of one or more red LEDs 220. The current input terminal of the LED 261 is further coupled to a respective current output terminal of each of the plurality of impedance-providing components 231-23M. With the addition of the LED string 260, the color of the light emitted by the LED device 200 may be changed.

Figure 3B:
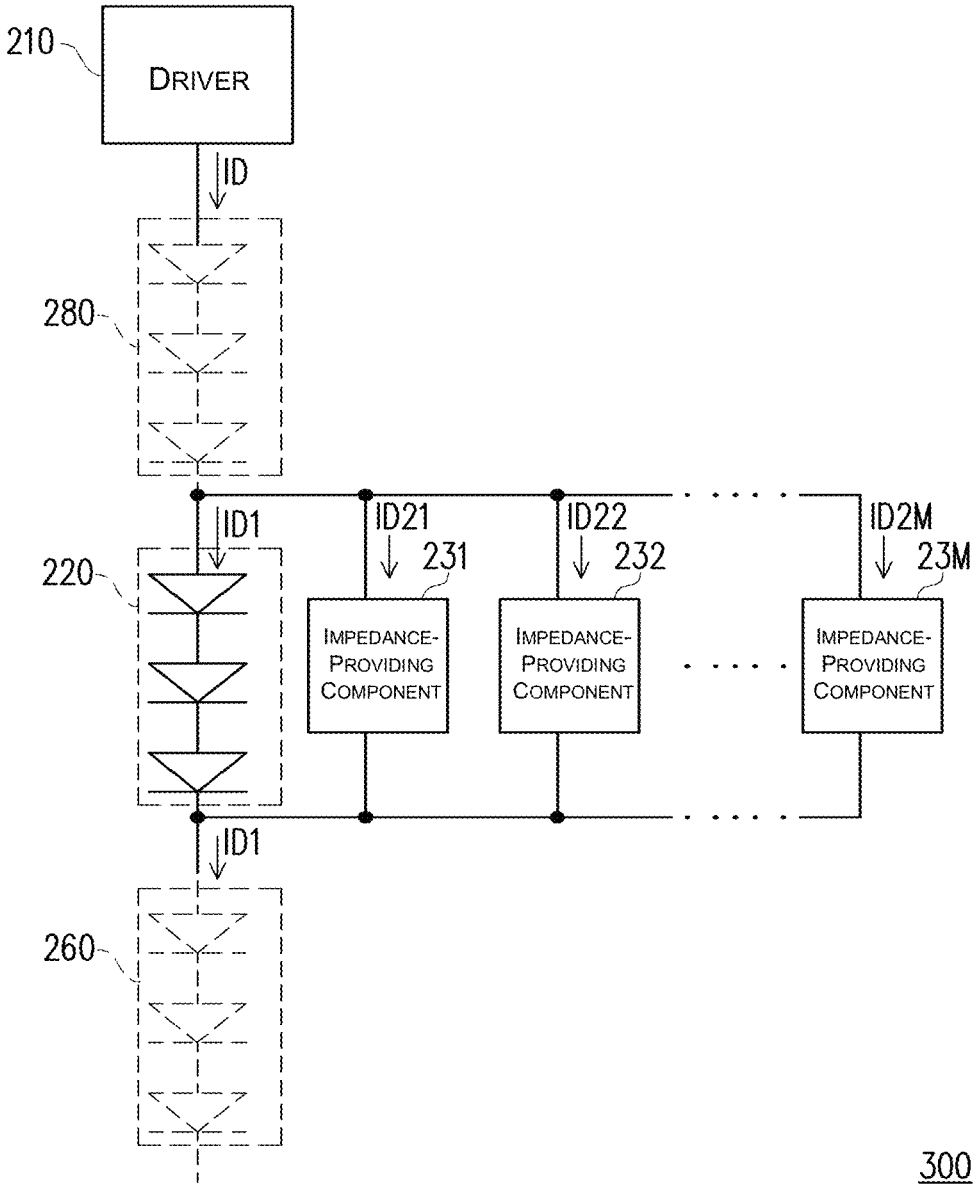
FIG. 3B is a block diagram of an LED device in accordance with still another embodiment of the present invention.

FIG. 3B illustrates an LED device 300 in accordance with still another embodiment of the present invention. Compared with the example shown in FIG. 3A, the LED device 300 includes two strings of non-red LEDs, namely a string of one or more non-red LEDs 260 and a string of one or more non-red LEDs 280. The string of one or more non-red LEDs 280 may be coupled in series between the driver 210 and the string of one or more red LEDs 220. In various embodiments, the strings of one or more non-red LEDs 260 and 280 may be placed in various locations in the circuit and still be coupled in series with the driver 210 and the string of one or more red LEDs 220. Furthermore, the quantity of strings of one or more non-red LEDs is not limited to the two strings 260 and 280.

Of course, the quantity of LEDs in each of the strings of one or more non-red LEDs 260 and 280 is not limited to 3. In various embodiments, the proposed technique may be implemented with each of the strings of one or more non-red LEDs 260 and 280 including at least one non-red LED. Additionally, the attenuation in brightness (luminous decay, light attenuation, light decay, light decline or light degradation) is generally more severe in red LEDs than in non-red LEDs.

In one embodiment, either or both of the strings of one or more non-red LEDs 260 and 280 may include one or more blue LEDs. In one embodiment, the strings of one or more non-red LEDs 260 and 280 may include one or more non-red LEDs of one or more other colors such as, for example, a blue LED, a green LED, a yellow LED, an orange LED, an ultraviolet LED, a near blue LED, a white LED, or a combination thereof.

Figure 4:
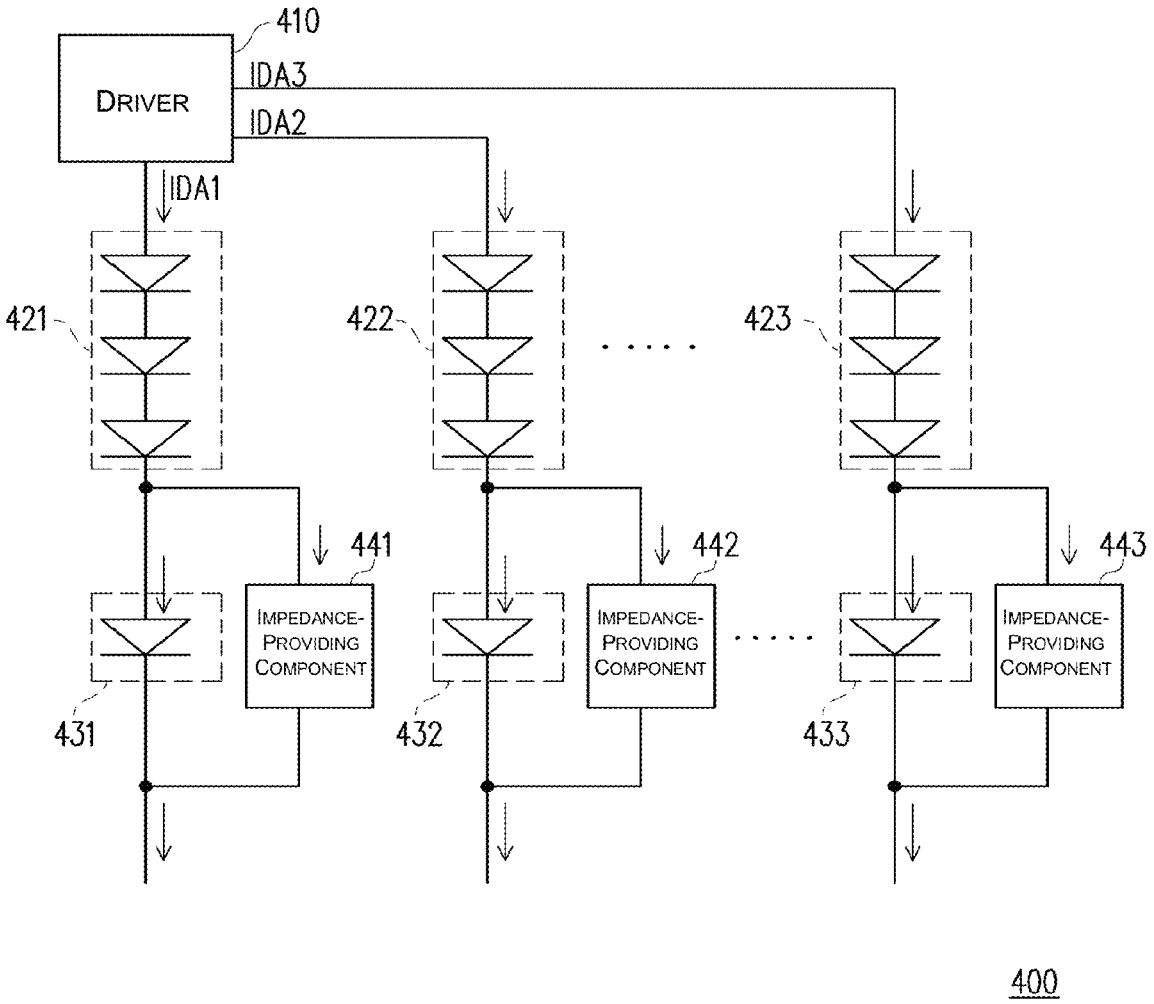
FIG. 4 is a block diagram of a lighting apparatus in accordance with an embodiment of the present invention.

FIG. 4 illustrates a lighting apparatus 400 in accordance with an embodiment of the present invention. The lighting apparatus 400 includes a driver 410, a plurality of strings of one or more blue LEDs 421-423, a plurality of strings of one or more red LEDs 431-433, and a plurality of impedance-providing components 441-443. The driver 410 generates a plurality of drive currents IDA1-IDA3 that are provided to the strings of one or more blue LEDs 421-423, respectively. More specifically, after flowing through the string of one or more blue LEDs 421, the drive current IDA1 is divided to flow through the impedance-providing component 441 and the string of one or more red LEDs 431. After flowing through the string of one or more blue LEDs 422, the drive current IDA2 is divided to flow through the impedance-providing component 442 and the string of one or more red LEDs 432. After flowing through the string of one or more blue LEDs 423, the drive current IDA3 is divided to flow through the impedance-providing component 443 and the string of one or more red LEDs 433. The wavelength of the light emitted by each of the strings of one or more red LEDs 431-433 is greater than the wavelength of the light emitted by each of the strings of one or more blue LEDs 421-423. In general, each non-red LED in the present invention is selected such that the wavelength of the light emitted by a red LED is greater than the wavelength of the non-red LED.

The driver 410 may utilize a current mirror to mirror the drive current IDA1 to provide the drive currents IDA2 and IDA3. As circuits of current mirrors are well known in the art, in the interest of brevity a detailed description thereof will not be provided herein.

With respect to the compensation for the attenuation in the brightness of the strings of one or more red LEDs 431-433 using the impedance-providing components 441-443, since an example and the principle of operation have been provided above, in the interest of brevity a detailed description thereof will not be provided herein.

Figure 5A:
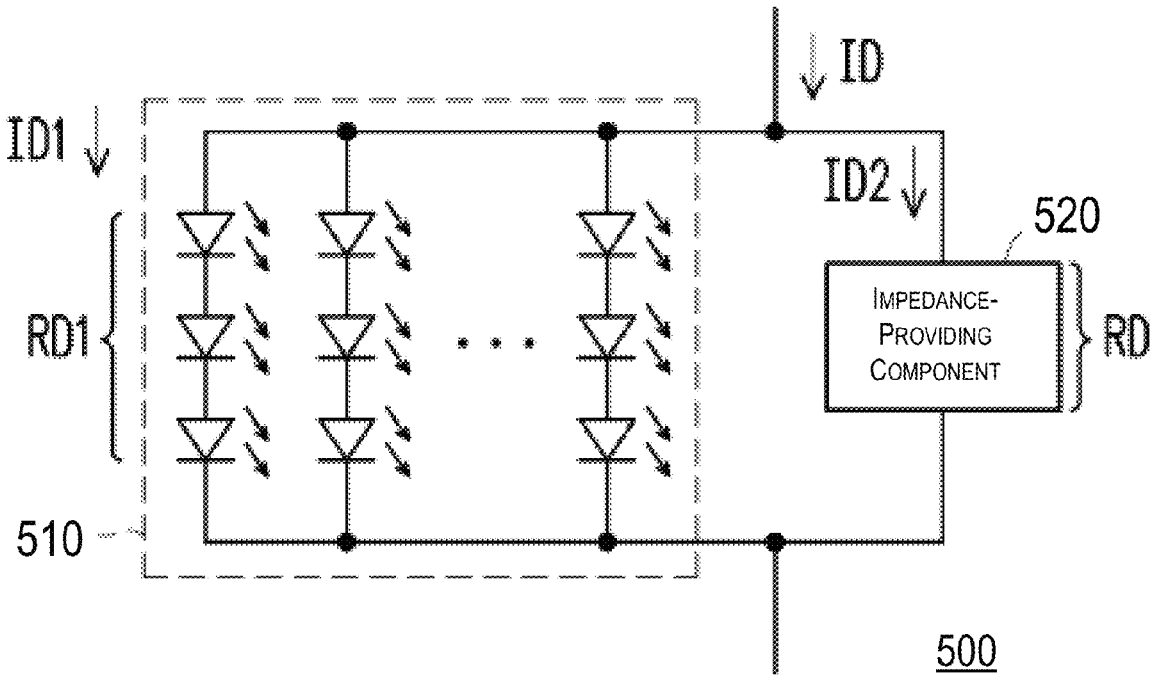
FIG. 5A is a block diagram of an LED device in accordance with one with yet another embodiment of the present invention.

FIG. 5A illustrates an LED device 500 in accordance with one with yet another embodiment of the present invention. As shown in FIG. 5A, the LED device 500 includes an LED array 510 and an impedance-providing component 520. The LED array 510 includes numerous LEDs. The impedance-providing component 520 and the LED array 510 are electrically coupled together in parallel. The internal impedance RD of the impedance-providing component 520 varies according to an ambient temperature. The impedance-providing component 520 may include a semiconductor component or a thermistor such as, for example, a positive temperature coefficient (PTC) semiconductor component or thermistor, and is used to compensate for variation in the brightness of illumination by LEDs due to temperature. In other words, the driving current ID is divided into first driving current ID1 and second driving current ID2 according to Kirchhoff's current law. The first driving current ID1 is further sub-divided when flowing through multiple series of LEDs of the LED array 510. The second driving current ID2 flows through the impedance-providing component 520. Thus, the value of the driving current ID is equal to the sum of the values of the first and second driving currents ID1, ID2. Moreover, a voltage drop across the LED array 510 and a voltage drop across the impedance-providing component 520 are equal.

The values of the first and second driving currents ID1, ID2 are determined by a ratio between the internal impedance RD of the impedance-providing component 520 and the internal impedance RD1 of the LED array 510. Notably, in one embodiment, the internal impedance RD of the impedance-providing component 520 varies in positive proportion to a variation in the ambient temperature. In one embodiment, when the impedance-providing component 520 includes a PTC semiconductor component or thermistor, the internal impedance RD varies in positive proportion to a variation in the ambient temperature. That is, with a rise in the ambient temperature, the internal impedance RD of the impedance-providing component 520 increases; and when the ambient temperature drops the internal impedance RD of the impedance-providing component 520 decreases.

Simply put, when the internal impedance RD of the impedance-providing component 520 is great than the internal impedance RD1 of the LED array 510, the value of the first driving current ID1 is greater than the value of the second driving current ID2. Conversely, when the internal impedance RD of the impedance-providing component 520 is less than the internal impedance RD1 of the LED array 510, the value of the first driving current ID1 is less than the value of the second driving current ID2. Of course, when the internal impedance RD of the impedance-providing component 520 is equal to the internal impedance RD1 of the LED array 510, the driving current ID is equally divided between the first driving current ID1 and the second driving current ID2.

From the description above, those skilled in the art would appreciate that, after the LED device 500 has been in operation for a long period of time, the internal impedance RD of the impedance-providing component 520 increases as the ambient temperature rises with passage of time. With an increase in the internal impedance RD, the first driving current ID1 which flows through the LED array 510 also increases accordingly. The increase in the first driving current ID1 corresponding to an increase in the ambient temperature effectively compensates for an attenuation in the brightness of the LED array 510 that would have occurred without such compensating effect. This effectively compensates for the characteristic of light decay of LEDs.

Figure 5B:
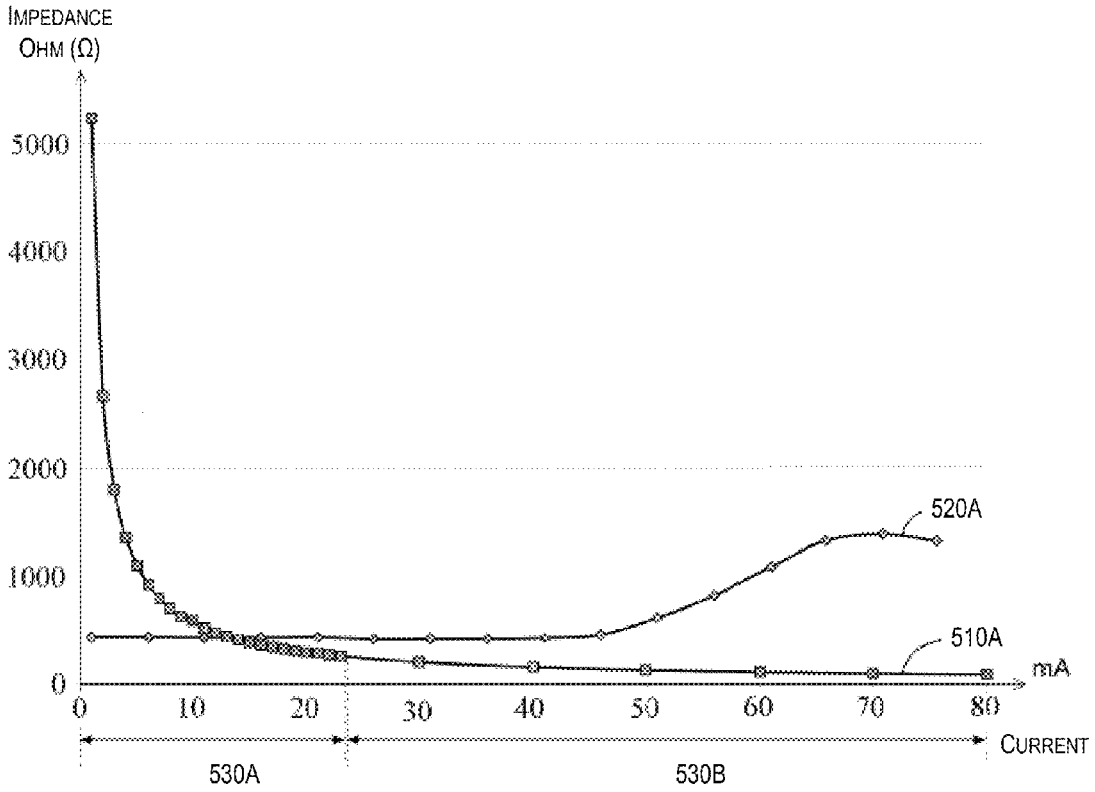
FIG. 5B is a diagram showing a relationship between impedance and current with respect to an embodiment of the present invention.

FIG. 5B illustrates a relationship between impedance and current with respect to an embodiment of the present invention. The following description refers to both FIGS. 5A and 5B. In one embodiment, when the LED array 510 includes numerous red LEDs, an equivalent internal impedance RD1 thereof is measured and shown as the characteristic curve 510A. The internal impedance RD of the impedance-providing component 520 is measured and shown as the characteristic curve 520A, which is approximately a straight line in the range of 0~46 mA and becomes a generally upward curve for current values greater than 46 mA. The characteristic curve 520A shows that, for relatively small currents, the internal impedance RD of the impedance-providing component 520 is at an approximately constant and small value. On the other hand, for relatively large currents, the internal impedance RD of the impedance-providing component 520 has a generally rising value.

The characteristic curve 510A of FIG. 5B is measured using three strings of red LEDs coupled in parallel with the value of current varying in a wide range including an incomplete conduction region 530A and a conduction region 530B. The incomplete conduction region 530A ranges between 0 mA and 23 mA. The conduction region 530B ranges between 23 mA and 80 mA or a range above 23 mA. In the incomplete conduction region 530A, the value of the internal impedance RD1 of the LED array 510 increases exponentially as the current decreases to approach and surpass the value of the internal impedance RD of the impedance-providing component 520, resulting in impedance mismatch. In the conduction region 530B, the value of the internal impedance RD1 is linear as the value of current increases and maintains an approximately constant value that is less than the value of the internal impedance RD. On the other hand, the characteristic curve 520A is linear for the range of 0~46 mA and maintains an approximately constant value. Given that the value of the internal impedance RD1 of the LED array 510 is different under currents of different values, impedance mismatch between that of the LED array 510 and the impedance-providing component 520. Under a low current (e.g., for a current equal to or less than 15 mA), a majority portion of the current flows through the impedance-providing component 520 with a minority portion of the current flowing through the LED array 510. Accordingly, a color temperature offset of about 2000 K (degree Kelvins) may occur in the LED array 510 as a result of inability to achieve desired luminous efficiency under a current in the range of 15 mA to 80 mA or even 200 mA. It is noteworthy that implementations of the LED array 510 are not limited to red LEDs, and that the values of current and impedance may be different from those shown depending on actual implementations.

Figure 6A:
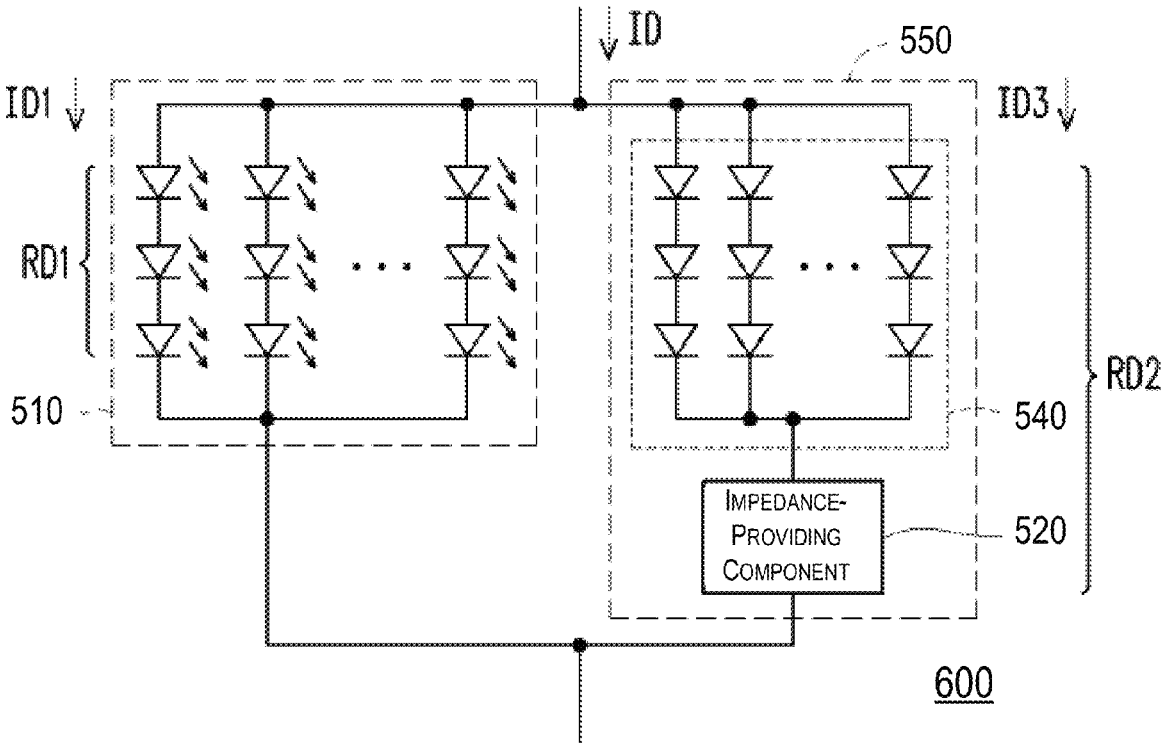
FIG. 6A is a block diagram of an LED device in accordance with one other embodiment of the present invention.
Figure 6B:
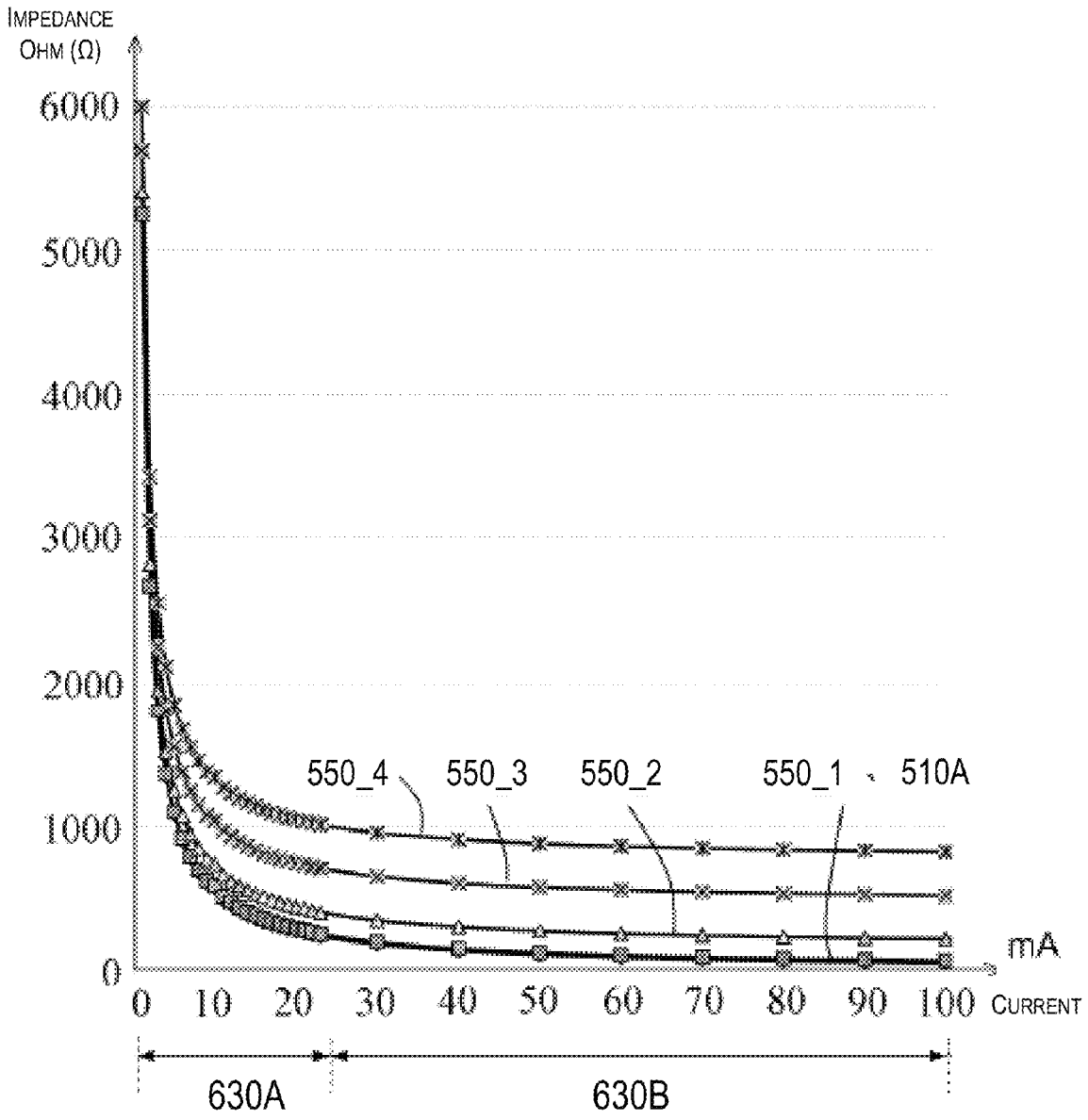
FIG. 6B is a diagram showing a relationship between impedance and current with respect to an embodiment of the present invention.

FIG. 6A illustrates an LED device 600 in accordance with one other embodiment of the present invention. FIG. 6B illustrates a relationship between impedance and current with respect to an embodiment of the present invention. The following description refers to both FIGS. 6A and 6B. To improve the issue of color temperature offset, the LED device 600 includes an LED array 510 and an adjustment module 550. The adjustment module 550 includes an impedance-providing component 520 and an LED array 540 coupled in series. The adjustment module 550 is coupled in parallel with the LED array 510. In one embodiment, the adjustment module 550 plays the role of variation in impedance and does not contribute to brightness. In another embodiment, the adjustment module 550 not only provides variation in impedance but also contributes to brightness.

The LED array 510 includes multiple first LEDs and has an internal impedance RD1 which exhibits the property of the characteristic curve 510A. In the interest of brevity, detailed description of the characteristic curve 510A is not repeated herein.

The LED array 540 may include one or more diode, one or more Zener diode or one or more LED, and may exhibit similar or identical property as that of the LED array 510. In one embodiment, an internal impedance of the LED array 540 is approximately equal to the internal impedance RD1 of the LED array 510. The adjustment module 550 has an equivalent internal impedance RD2. The internal impedance RD2 may exhibit similar or identical property as that of variations of the characteristic curve 550_1-550_4. In one embodiment, the impedance-providing component 520 is a PTC thermistor and the LED array 540 is a red array. The characteristic curve 550_1 measures the variation in impedance of a PTC thermistor having an internal impedance of 15 ohms at room temperature and the red LED array in series. The characteristic curve 550_2 measures the variation in impedance of a PTC thermistor having an internal impedance of 150 ohms at room temperature and the red LED array in series. The characteristic curve 550_3 measures the variation in impedance of a PTC thermistor having an internal impedance of 300 ohms and the red LED array in series. The characteristic curve 550_4 measures the variation in impedance of a PTC thermistor having an internal impedance of 450 ohms and the red LED array in series. For relatively small currents, relative to the characteristic curve 510A, the characteristic curves 550_4, 550_3, 550_2 and 550_1 exhibit a consistently increasing trend as the value of current decreases. For relatively large currents, the characteristic curves 550_4, 550_3, 550_2 and 550_1 exhibit a linear relationship and each maintains an approximately constant value. Among them, the characteristic curves 550_4, 550_3, 550_2 and 550_1 decrease in value in that order. The characteristic curves 550_4, 550_3 and 550_2 are apart from the characteristic curve 510A, while the characteristic curves 510A and 550_1 overlap. The range covered by the characteristic curves 550_4, 550_3, 550_2 and 550_1 include an incomplete conduction region 530A and a conduction region 530B. The incomplete conduction region 530A ranges between 0 mA and 23 mA. The conduction region 530B ranges between 23 mA and 80 mA or a range above 23 mA.

Figure 6C:
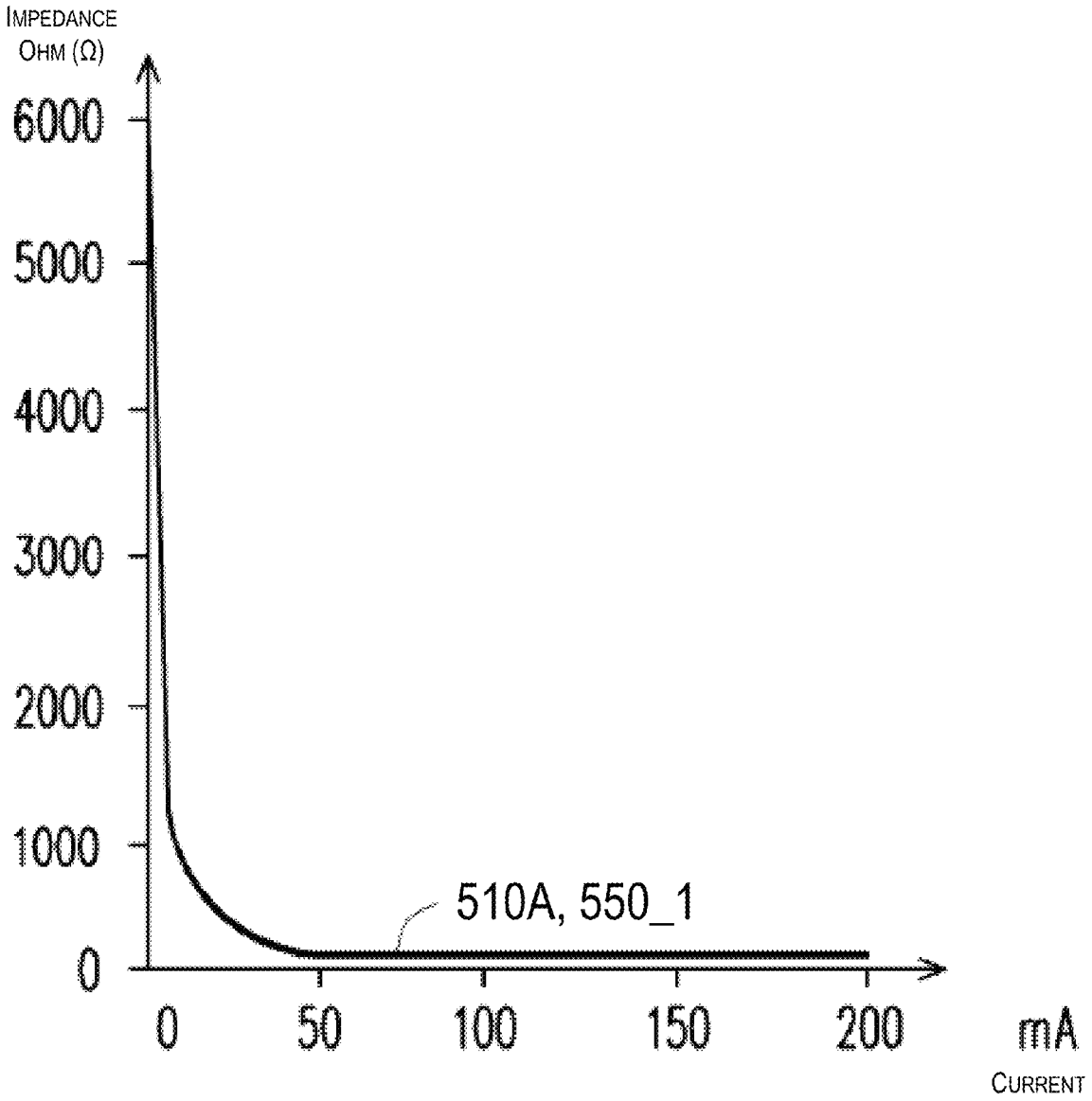
FIG. 6C is a diagram showing a relationship between impedance and current with respect to another embodiment of the present invention.

FIG. 6C illustrates a relationship between impedance and current with respect to another embodiment of the present invention. The following description refers to FIG. 6C. Ideally, under room temperature (e.g., 25° C.), it is desired that the PTC thermistor has an internal impedance approximately close to zero. In one embodiment, under room temperature (e.g., 25° C.), the design of the impedance-providing component 520 may be chosen such that the spacing between two characteristic curves can be reduced. For example, under room temperature and for an impedance value of 15 ohms, the characteristic curves 510A and 550_1 of the impedance-providing component 520 overlap and appear to be identical. That is, as the characteristics in variation of impedance corresponding to current are identical and overlap each other, applications thereof can be in the incomplete conduction region and the conduction region. In other words, the internal impedance RD1 varies similarly as does the internal impedance RD1. Although the above example pertains to the case of 15 ohms, other embodiments are not limited thereto.

Moreover, the driving current ID is divided into driving currents ID1 and ID3. The driving currents ID1 and ID3 flow through the LED array 510 and adjustment module 550, respectively. As the values of impedance of the two corresponding characteristic curves decrease exponentially as the value of the respective current increases, or as the linear portions of the two characteristic curves have similar proportion, the internal impedance RD2 and the internal impedance RD1 maintain a similar proportion from a relatively small value of current (e.g., close to zero current) to a relatively large current (e.g., driving current during normal operation). The driving current ID3 is similarly proportional to the driving current ID1, thus achieving a stable effect. Accordingly, even though the driving currents ID1 and ID3 may be in the incomplete conduction region, the internal impedances RD1 and RD2 can still vary in similar proportion so that the driving current ID3 will not be much greater than the driving current ID1. Thus, a constant ratio between the currents flowing through the LED array 510 and the adjustment module 550 can be maintained with embodiments of the present invention, thereby aiding the LED array 510 in actually achieving brightness while minimizing a range of color temperature offset.

Therefore, other than dynamically adjusting light to minimize the range of color temperature offset, the LED device 200 can also compensate for brightness under high temperature to thereby avoid the issue of light decay due to high temperature. On the other hand, if the characteristic curves 510A and 550_1 of component(s) used are very similar so as to overlap in terms of the relationship between internal impedance and current, the range of color temperature offset can be further minimized.

Accordingly, although a circuit design such as that shown in FIG. 5A can compensate for light decay in LEDs, a color temperature offset of 2000K in the LED array 510 can still occur for values of current between 15 mA and 200 mA. With respect to the circuit design shown in FIG. 6A, the color temperature offset can be reduced to 200K or lower from 2000K when the characteristic curves 510A and 550A overlap. Thus, the issue of color temperature offset due to change in temperature or operating current in conventional LED devices can be mitigated or avoided in the LED device 200.

Figure 7:
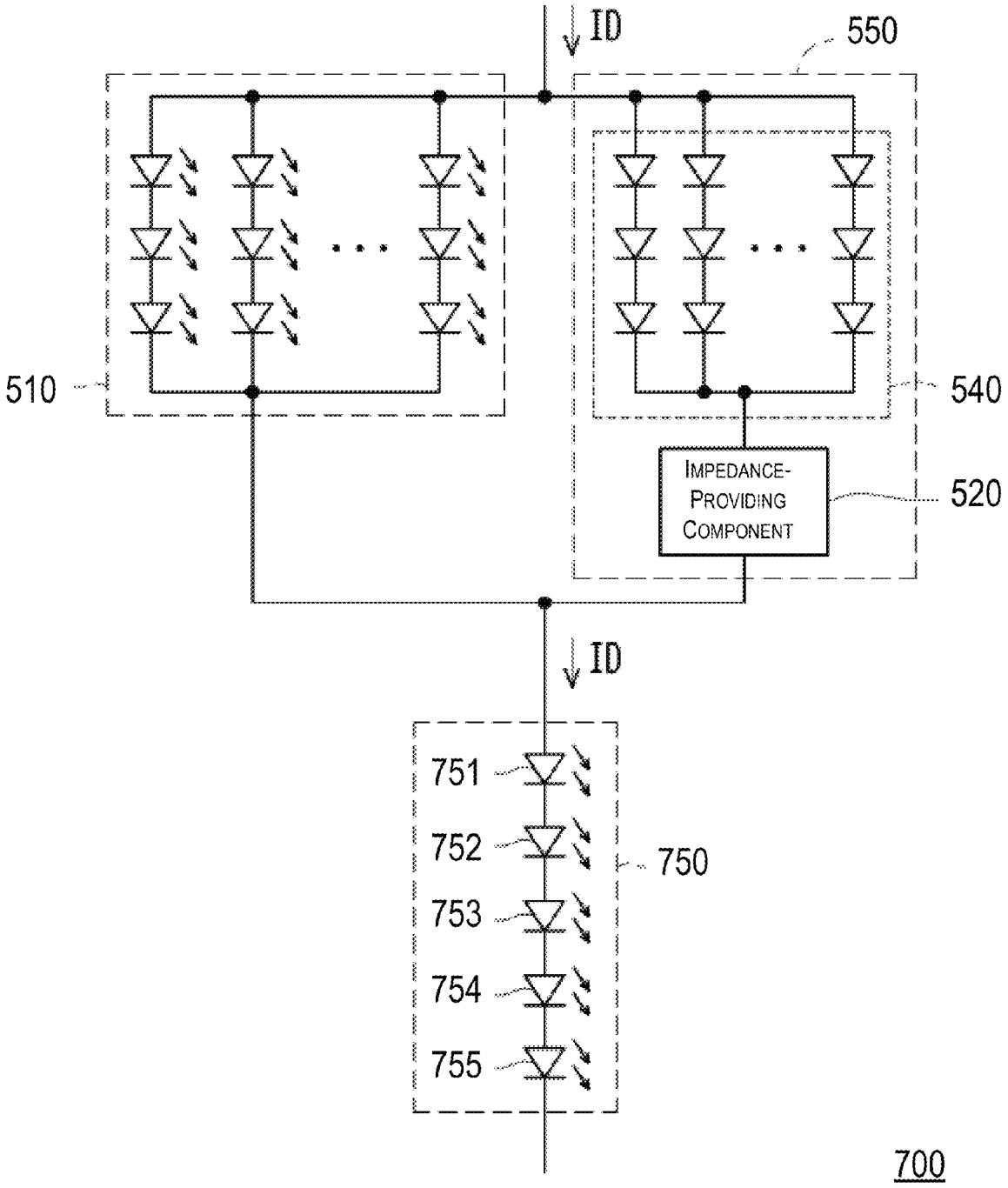
FIG. 7 is a block diagram of an LED device in accordance with a further embodiment of the present invention.

FIG. 7 illustrates an LED device 700 in accordance with a further embodiment of the present invention. The following description refers to FIG. 7. In one embodiment, relative to the example shown in FIG. 6A, the LED device 700 further includes an LED array 750. The LED array 750 is coupled in series with the LED array 510 and with the adjustment module 550, and emits light with the driving current ID flowing through. The LED array 510 may include multiple red LEDs, and the LED array 750 may include multiple non-red LEDs 751-755 that are coupled in series. More specifically, a current input terminal of the LED 751 is electrically coupled to a current output terminal of a red LED of the LED array 510 as well as to a current output terminal of the impedance-providing component 520. With the addition of the LED array 750, the color of light emitted by the LED device 700 can be changed. The LEDs of the LED array 750 may be coupled in parallel, in series, or in a parallel-series combination.

Of course, the number of non-red LEDs in the LED array 350 is not limited to five as shown in FIG. 7. Depending on the actual implementation, the LED array 750 may include at least one non-red LED. Furthermore, light decay in red LEDs tends to be more severe and in a greater magnitude than in non-red LEDs.

In one embodiment, the red LEDs emit light of a first wavelength and the non-red LEDs emit light of a second wavelength that is different from the first wavelength. In one embodiment, the non-red LEDs in the LED array 350 may be blue LEDs or LEDs of other color such as, for example, green LEDs, yellow LEDs, orange LEDs, purple LEDs, near-blue LEDs or white LEDs.

Figure 8A:
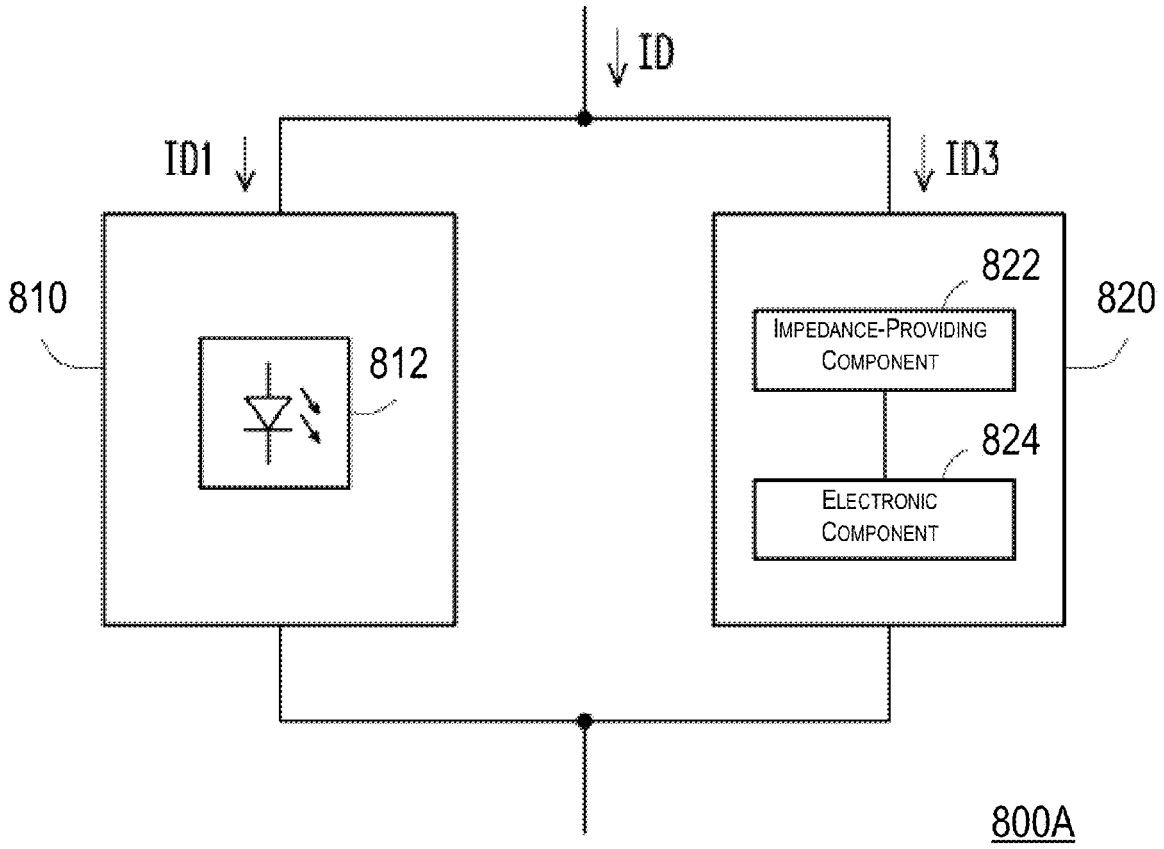
FIG. 8A is a block diagram of an LED device in accordance with still a further embodiment of the present invention.

In view of the above, an LED device of the present invention may be generally descried as follows. More specifically, FIG. 8A illustrates an LED device 800A in accordance with still a further embodiment of the present invention. Referring to FIG. 8A, the LED device 800A includes a first adjustment module 810 and a second adjustment module 820. The first adjustment module 810 includes at least one first LED 812. The second adjustment module 820 includes an impedance-providing component 422 and an electronic component 424 that are coupled in series. The first adjustment module 810 and the second adjustment module 820 are coupled in parallel. The impedance-providing component 822 may include a PTC semiconductor component or thermistor. The electronic component 824 may include a diode, Zener diode, LED, diode array, Zener diode array or LED array, and is not limited thereto, so long as its characteristic curve and that of the first LED 812 are similar or identical. More detailed description related to the characteristic curves is provided below.

In operation, the first adjustment module 810 has a first internal impedance, and the second adjustment module 820 has a second internal impedance. The first internal impedance has a corresponding first characteristic curve (e.g., the characteristic curve 510A of FIG. 6B or 6C). The first characteristic curve covers a range that includes a first incomplete conduction region (e.g., region 630A in FIG. 6B) and a first conduction region (e.g., region 630B in FIG. 6B). The first internal impedance decreases exponentially as the current increases from zero in the first incomplete conduction region, and is approximately linear in the first conduction region. The second internal impedance has a corresponding second characteristic curve (e.g., the characteristic curve 550A of FIG. 6B or 6C). The second characteristic curve covers a range that includes a second incomplete conduction region (e.g., region 630A in FIG. 6B) and a second conduction region (e.g., region 630B in FIG. 6B). The second internal impedance decreases exponentially as the current increases from zero in the second incomplete conduction region, and is approximately linear in the second conduction region. The first and the second characteristic curves match one another in the incomplete conduction region as well as in the conduction region.

The driving current ID is divided into driving currents ID1 and ID3, and the value of the driving current ID is equal to the sum of the values of the driving currents ID1 and ID3. As the first and the second characteristic curves match one another, the driving currents ID3 and ID1 vary as the driving current ID varies and maintain in the same proportion. Thus, embodiments thereof can further minimize the range of color temperature offset.

Figure 8B:
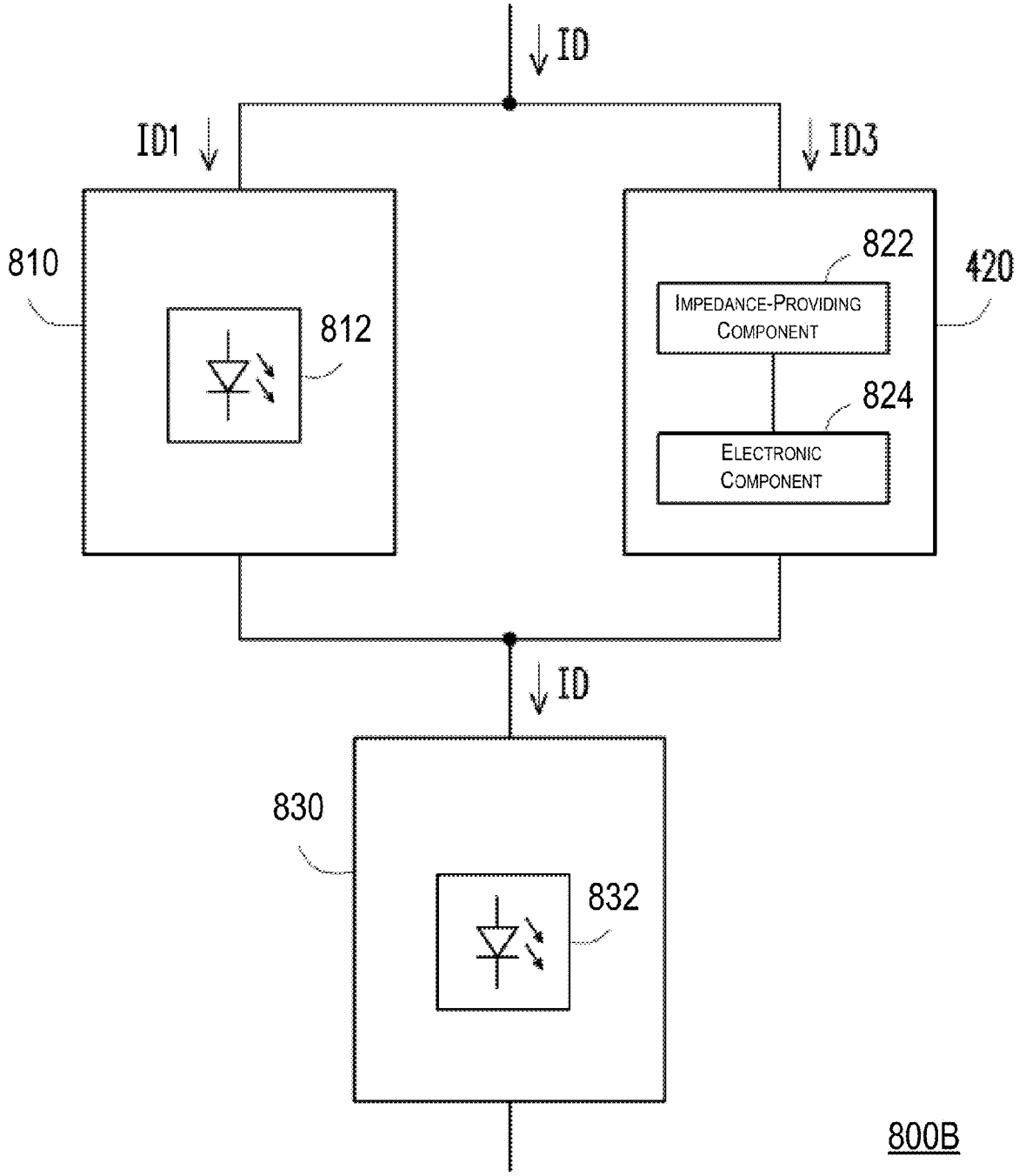
FIG. 8B is a block diagram of an LED device in accordance with yet a further embodiment of the present invention.

FIG. 8B illustrates an LED device 800B in accordance with yet a further embodiment of the present invention. Referring to FIG. 8B, relative to the example illustrated in FIG. 8A, the LED device 800B further includes a third adjustment module 830. The third adjustment module 830 includes at least one second LED 832. The at least one first LED 812 emits light of a first wavelength, and the at least one second LED 832 emits light of a second wavelength that is different from the first wavelength. The third adjustment module 830 is respectively coupled in series with the first adjustment module 810 and the second adjustment module 820, and receives the driving current ID to emit light. With the addition of the third adjustment module 430, the LED device 400B can change the color of the emitted light. For example, the at least one first LED 812 and the at least one second LED 832 may be red LED and blue LED, respectively, yet the present invention is not limited thereto.

The terms "internal resistance", "internal impedance", "resistance value" and "impedance" as used in the above description are intended to have the same meaning, with ohm being the unit.

The term "ambient temperature" as used in the above description may refer to the ambient temperature of an LED device, LED array, LED(s), LED chip(s), adjustment module, diode array or impedance-providing component.

In any of the above-described LED arrays, the LEDs may be coupled in parallel, in series, or in a parallel-series combination. Additionally, one or more LED of the LED array 510 may be LED chips, LED packages or any combination thereof.

Aforementioned LEDs may include LEDs that emit red light, green light, blue light, white light or any combination thereof. White LEDs may include blue LED chips and yellow phosphor, and may include red LED chips or red phosphor. Moreover, aforementioned white LEDs may include one or more red LED chip, green LED chip and blue LED chip, may also include yellow phosphor, and may further include red phosphor. Furthermore, aforementioned phosphors may be evenly, unevenly or gradually distributed in the translucent encapsulant of the aforementioned LEDs in terms of density.

In short, embodiments of the LED device of the present invention include a first adjustment module and a second adjustment module coupled in parallel, with the first adjustment module including at least one LED and with the second adjustment module including an impedance-providing component and an electronic component coupled in series. With the first characteristic curve of the first adjustment module matching the second characteristic curve of the second adjustment module, the LED device can dynamically adjust the emitting light to minimize the range of color temperature offset as well as compensate for light decay due to high temperature. Additionally, embodiments of the LED device of the present invention may be utilized for indoor illumination, outdoor illumination, backlight applications and indicator applications.

In summary, by coupling one or more impedance-providing components in parallel with a string of one or more red LEDs, the present invention provides an internal impedance having a value that depends on the ambient temperature. Correspondingly, the value of a partial drive current of a drive current provided by the driver that flows through the string of one or more red LEDs varies in accordance with the variation in the value of the internal impedance. Thus, the partial drive current that flows through the string of one or more red LEDs is adjusted according to the ambient temperature, thereby effectively compensating for the attenuation in brightness due to a rise in ambient temperature. This technique allows a lighting apparatus to emit light under high ambient temperature such that the emitted light still satisfies the requirement of the 7-step macadam and, optimally, the requirement of the 4-step macadam. In order to allow an impedance-providing component to effectively sense the ambient temperature to vary the partial drive current that flows through a string of one or more red LEDs, a distance between the impedance-providing component and the LEDs of the string of one or more red LEDs is no more than 5 centimeters. This distance is ideally less than 4 centimeters and optimally less than 3 centimeters. This design allows the impedance-providing component to effectively sense the ambient temperature so that the value of its shunt impedance varies proportionally according to a variation in the ambient temperature. In various embodiments, the LEDs described herein may be in the form of LED chips, LED packages, or a combination thereof.

A lighting apparatus in accordance with the present invention may be used in combination with any of the commercially available lighting modules, such as A40, A60, MR16, PAR30, PAR38 or GU10, with the use of yellow phosphor to produce white light. Moreover, red phosphor may be added to enhance color saturation. Furthermore, LED devices in accordance with the present invention may be used in indoor lighting apparatuses, outdoor lighting apparatuses, backlight modules, and indicator devices.

Although specific embodiments of the present invention have been disclosed, it will be understood by those of ordinary skill in the art that the foregoing and other variations in form and details may be made therein without departing from the spirit and the scope of the present invention. The scope of the present invention is defined by the claims provided herein.

What is claimed is:

1. A light emitting diode (LED) device, comprising:

a first adjustment module having a first internal impedance, the first adjustment module comprising at least one first LED and coupled to receive a first current, a first characteristic curve representing a relationship between the first internal impedance and the first current with a range of the first characteristic curve including a first incomplete conduction region and a first conduction region, wherein in the first incomplete conduction region the first internal impedance decreases exponentially as the first current increases, and wherein the first internal impedance is approximately linear in the first conduction region; and a second adjustment module, comprising an impedance-providing component and an electronic component coupled in series and coupled to receive a second current, the second adjustment module and the first adjustment module coupled in parallel, the second adjustment module having a second internal impedance, a second characteristic curve representing a relationship between the second internal impedance and the second current with a range of the second characteristic curve including a second incomplete conduction region and a second conduction region, wherein in the second incomplete conduction region the second internal impedance decreases exponentially as the second current increases, and wherein the second internal impedance is approximately linear in the second conduction region, wherein the first characteristic curve and the second characteristic curve match one another.

2. The LED device of claim 1, wherein the impedance-providing component comprises a semiconductor component or a thermistor having a positive temperature coefficient.

3. The LED device of claim 1, wherein the electronic component comprises a diode, a Zener diode, an LED, a diode array, a Zener diode array, or an LED array.

4. The LED device of claim 1, further comprising:

a third adjustment module that comprises at least one second LED, the third adjustment module coupled in series with the first adjustment module and with the second adjustment module, respectively.

5. The LED device of claim 4, wherein the at least one first LED emits light of a first wavelength, and wherein the at least one second LED emits light of a second wavelength that is different from the first wavelength.

6. The LED device of claim 5, wherein the at least one first LED and the at least one second LED comprise a red LED and a blue LED, respectively.

* * * * *